US009330554B2

(12) United States Patent
Calvar Antón et al.

(10) Patent No.: US 9,330,554 B2
(45) Date of Patent: May 3, 2016

(54) MARITIME ALARM AND RESCUE SYSTEM AND METHOD FOR CONTROLLING SAID SYSTEM

(75) Inventors: José María Calvar Antón, Gondomar (ES); Fernando Isasi Vicente, Gondomar (ES)

(73) Assignee: Aeromarine, S.L., Gondomar (Pontevedra) (ES)

( * ) Notice: Subject to any disclaimer, the term of this patent is extended or adjusted under 35 U.S.C. 154(b) by 79 days.

(21) Appl. No.: 14/112,908

(22) PCT Filed: Sep. 23, 2011

(86) PCT No.: PCT/ES2011/070666

§ 371 (c)(1),
(2), (4) Date: Apr. 15, 2014

(87) PCT Pub. No.: WO2013/041740

PCT Pub. Date: Mar. 28, 2013

(65) Prior Publication Data

US 2014/0218217 A1 Aug. 7, 2014

(51) Int. Cl.
*G08B 23/00* (2006.01)
*G08B 21/08* (2006.01)
(Continued)

(52) U.S. Cl.
CPC ..... *G08B 21/088* (2013.01); *B63C 9/0005* (2013.01); *B63C 9/08* (2013.01); *B63C 2009/0017* (2013.01)

(58) Field of Classification Search
CPC ..... G08G 3/00; B63B 43/00; B63B 49/00; B63J 2099/008; B63J 99/00; G08B 25/009; G08B 21/088; B63C 2009/0017; B63C 9/0005; B63C 9/08; G01S 13/9307; G01S 1/68; G01S 5/0018; G06F 3/04817
USPC ..... 340/984, 985, 573.1, 539.1, 539.11, 340/539.13, 573.6, 7.5, 6.1, 539.26, 531
See application file for complete search history.

(56) References Cited

U.S. PATENT DOCUMENTS 6,567,004 B1 * 5/2003 Landa et al. ..... 340/573.1
7,817,079 B1 * 10/2010 Funk ..... 342/41
(Continued)

FOREIGN PATENT DOCUMENTS

WO WO 02/077943 10/2002
WO WO 03/042032 5/2003
(Continued)

OTHER PUBLICATIONS

Chang, Shwu-Jing; "Vessel Identification and Monitoring Systems for Maritime Security"; 2003 IEEE; pp. 66-70.
(Continued)

*Primary Examiner* — Daniel Previl
(74) *Attorney, Agent, or Firm* — Blakely Sokoloff Taylor & Zafman LLP

(57) ABSTRACT

Particularly applicable to life jackets and suits, it makes it possible to provide a location and maximum safety of shipwrecked people who have fallen overboard, providing, in the event of a man overboard (MOB) situation, a fast and effective solution, as the alert system continues in its attempt to communicate until a vessel responds with a signal of acknowledgement. The alert system fundamentally stands out due to the location and communication achieved by the DSC calling device and the AIS identification device. For its part, the control process stands out as it allows performing a repetition of search in the localization of the vessels in the immediate vicinity of the own vessel (vessel that the crew member comes from), so that if said own ship does not respond to the emergency call of the shipwrecked person, it communicates with other adjacent vessels.

16 Claims, 1 Drawing Sheet

(51) Int. Cl.
*B63C 9/08* (2006.01)
*B63C 9/00* (2006.01)

(56) References Cited

U.S. PATENT DOCUMENTS

| | | | | |
|---|---|---|---|---|
| 2005/0040987 | A1* | 2/2005 | Bruno et al. | 342/357.08 |
| 2008/0117082 | A1* | 5/2008 | Su | 340/985 |
| 2009/0079590 | A1* | 3/2009 | Hiraoka | 340/984 |
| 2011/0075602 | A1* | 3/2011 | Peach et al. | 370/326 |

FOREIGN PATENT DOCUMENTS

| | | |
|---|---|---|
| WO | WO 2009/083731 | 7/2009 |
| WO | WO 2010/023639 | 3/2010 |

OTHER PUBLICATIONS

Naoues, Malek, et al; "Design of an RF-Subsampling based tri-band AIS and DSC Radio Receiver"; 2009 IEEE; pp. 64-68.

* cited by examiner

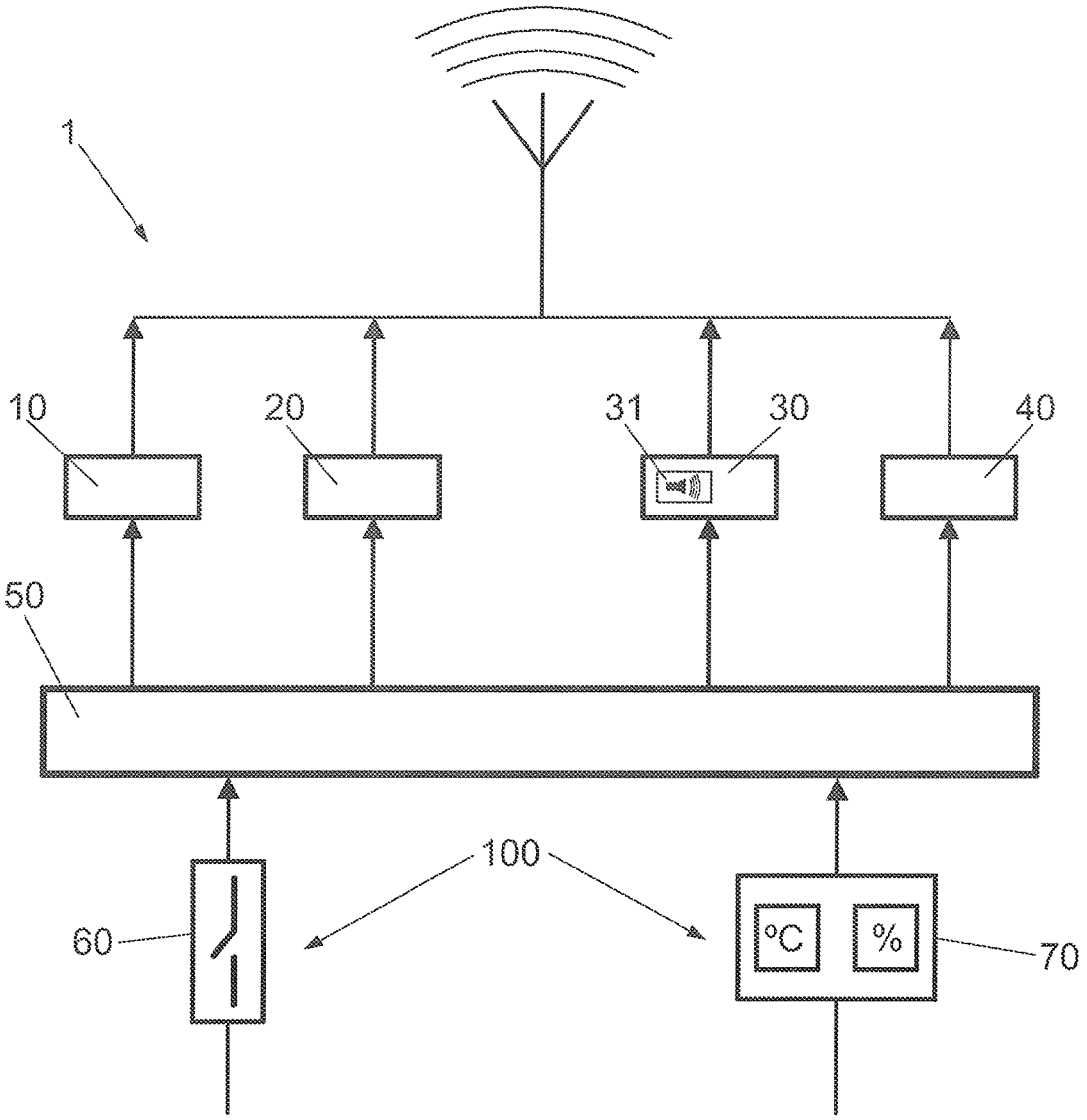
1
10
20
31
30
40
50
100
60
°C
%
70

MARITIME ALARM AND RESCUE SYSTEM AND METHOD FOR CONTROLLING SAID SYSTEM

The present patent application is a national phase application of International Application No. PCT/ES2011/070666, filed Sep. 23, 2011.

OBJECT OF THE INVENTION

The present invention belongs to the maritime rescue sector, and more specifically to alert systems of "man overboard" type, identification and rescue of persons who have fallen into the sea.

The main object of the present invention is an alert and rescue system of shipwrecked persons, as well as the control process of said system, whereby the location and identification processes of the persons who have fallen into the sea are maximized and optimized for their later rescue.

BACKGROUND OF THE INVENTION

At present, different alert and maritime safety systems are known for the rescue of crew members who have fallen into the water, also known as PLB (Personal Locator Beacon) systems for situations of "man overboard" (MOB).

Said systems are generally based on emitter devices that work in the international rescue frequency, 121.5 MHz for civil use, and 243 MHz for military, and that due to the short range of its emission are only received by ships with receivers in said frequencies, which sail close to the accident (maximum 4-5 nautical miles).

Within these systems there are various modes of operation, with a greater or lesser success, which transmit the position of the shipwrecked person by the incorporation of a Global Positioning System (GPS, GLONASS, GALILEO, . . . ), hereinafter GPS, and the encoding of said position in the carrier wave, with the drawback of requiring a decoder onboard, specific for each manufacturer as there does not exist a coding regulation of said signal.

Likewise, global positioning systems are known, both of personal use and for the own ship, which, based on the different satellite navigation systems recognized by the GMDSS system (such as COSPAS SARSAT, GALILEO, GLONASS), send the satellites data regarding the position and identification of the victim using the 406 MHz frequency, and this information later reaches the maritime rescue coordination centres onshore, which report to the national authorities in whose waters the accident has occurred. These systems are not recognized for personal use nor are they accepted by the International Maritime Organization (IMO) or the International Convention for the Safety of Life at Sea (SOLAS).

On the other hand, signal emitting equipment of the MOB emergency signal by the name "Digital Selective Calling" (DSC) are currently on the market. DSC emissions are a subsystem of the GMDSS global system, which regulates all onboard safety and radio communication means. Said DSC call is a call which exclusively transmits data in communication channel 70, and it has several levels of severity (distress, urgent and safety). Again, both IMO and SOLAS are against the indiscriminate use of said channel 70 for personal use by the shipwrecked person, though not of the ship, faced with the possibility of generating a huge number of calls produced by false alarms, improper use, etc., causing a saturation of the channel. It is for this reason that it is desirable to look for a way to limit the use of said channel 70.

Finally, PLB-AIS calls are known, which using the AIS (Automatic Identification System) system, emit every given period of time, in accordance with the vessel speed but with a minimum of at least one emission every 5 minutes. Generally, the identifying data of the transmitter are the MMSI, position, speed and course. This emission is performed via VHF (emission in the frequencies of 161975 MHz and 162025 MHz), but unlike previous systems they do not give an alarm system, but simply inform of a position, which in principle shall be confused with that of a ship and not that of a shipwrecked person in MOB situation.

More specifically, emitter-receiver systems are known wherein the person who has fallen into the water emits a radiofrequency signal that is initially received by the vessels nearby the accident, and which is sent to shore by repetition of stations in vessels, called "MAYDAY RELAY", until reaching a coastguards station located onshore, which coordinates the alarm and rescue process.

The technical problem posed here is that the current location systems do not allow a repeated search in terms of the location of the vessels in the immediate vicinity of the own ship (ship from which a crew member has fallen), so that with said current systems, if the own ship does not respond after the call of the shipwrecked person, there is no possible identification thereof by another vessels which may be a few miles away, the last hope remaining, and only if a general DSC call of maximum priority has been made, called "MAYDAY", that the coastguards station has correctly received the coordinates of the shipwrecked person, this way of acting being very slow, dangerous and can clearly be optimized, as in these cases of extreme urgency every minute that passes is of vital importance. The ships located in the VHF range of the general DSC call will also receive the alarm signal, but will wait for the coastguard's station to check the veracity of said alarm, to then be coordinated by it to collaborate in the rescue, if possible. But as mentioned above, this type of general DSC call is totally questioned by the IMO, and it will be very difficult for it to be implemented in the GMDSS system of global application with no type of modification.

DESCRIPTION OF THE INVENTION

The present invention resolves the aforementioned drawbacks, providing an alert and maritime rescue system, particularly applicable to life jackets and/or onboard work suits, as well as a control process of said system, whereby maximum safety is provided for the crew members of a vessel, and in the event of a man overboard situation, hereinafter MOB, give a fast, effective and complete solution, performing a repetitive search of nearby vessels, without stopping in the attempt to communicate until a vessel of those among the closest to the shipwrecked person responds with an ACK confirmation signal (acknowledgement), additionally doing all of this without causing saturation of data communication channel 70.

The alert and rescue system object of the invention is designed to be incorporated in the life jacket or work suit of the crew member of a vessel, said system comprising manual or automatic actuation means, which may consists of conductivity sensors of water, pressure, temperature or any other variable.

At the same time, the actuation means are connected to a control unit which analyses the signals from said sensors, managing them so that they produce the activation of the system exclusively in real MOB situations, thus avoiding possible false alarms. Said control unit activates a GPS (Global Positioning System) location device whereby it is possible to obtain the exact location of the shipwrecked person, and a radio beacon adapted to emit an alarm signal to the nearby vessels.

More specifically, the system of the present invention fundamentally stands out as it incorporates and integrates in a single piece of equipment the intelligent management of an alarm signal via radio signal emission/reception devices, which are:

a) a radio beacon that emits alarm signals in the 121.5/243 MHz frequency, international maritime rescue frequency in aerial band, b) a DSC (Digital Selective Calling) transceiver device, which works in the data communication channel 70 established by international maritime regulations, and which can furthermore be communicated by voice through emergency channel 16, it can however be any other channel that one wants to program, and c) an AIS (Automatic Identification System) transceiver device, hereinafter AIS device, which allows the reading of data of nearby vessels, and therefore, their identification by MMSI (Maritime Mobile Selective-call Identity) to later make a call using the DSC device, as well as the monitoring of the MOB position. It should be reminded that the MMSI (Maritime Mobile Selective-call Identity) is the number which identifies each vessel for security and telecommunications purposes.

The operation and control process of the alarm and rescue system object of the invention is described below:

As a MOB situation of "man overboard" occurs, the alert system of the present invention is activated through the manual or automatic actuation means, and which as has been commented above may be formed by sensors of a different nature, whether conductivity, pressure, temperature sensors, etc., which in turn are managed by the control unit to guarantee that the alert system is exclusively actuated in real MOB situations, avoiding false alarms.

From that very point when the falling of the man overboard occurs, the radio beacon starts the constant emission of an alarm signal until the final rescue of the shipwrecked person, this emission being in the frequency of 121.5/243 MHz. Said radio beacon alerts of the emergency situation both to aircraft and vessels equipped with receivers in this frequency and situated within the range of said alarm signal, also acting as "radio beacon" frequency for the onboard receivers of said vessels or aircraft, guiding them to the position of the shipwrecked person.

At the same time, the DSC device makes an emergency call exclusively to the own ship (ship the shipwrecked person comes from), making a communication both of data (channel 70), and voice (channel 16), raising the alarm of a MOB situation. It is reminded that, by regulation, all ships must be equipped with a DSC transceiver and a keep it permanently tuned to voice channel 16. Likewise, it should be indicated that this first emergency call does not incorporate the GPS position of the shipwrecked person, since the global positioning system takes between about 40 to 90 seconds to obtain the first position. However, it is obvious for the ship, that in those first few moments the shipwrecked person is at a few meters in its wake.

It is important to highlight that when in the present specification we speak of emergency calls made by the DSC device, all these DSC calls are calls exclusively of ship-to-ship type, i.e. only the ship called receives it and MAYDAY RELAY is not generated, thus avoiding that a general alert call occurs which may create a situation of generalized confusion in the shipping area, which would lead to the automatic MAYDAY RELAY making said alarm reach the coastguards station. In other words, the entire alarm is exclusively limited to the VHF range, the ships located in said area being those which at their criteria rescue or raise the alarm by the MAYDAY RELAY of a general alert call to said coastguards station.

From the first instant of activation of the radio beacon, the AIS device is also activated which starts to emit the position of the shipwrecked person, which can be seen by any vessel within the VHF range (approximately 5-10 miles), at the same time as it identifies and records the MMSI of all the ships situated within said VHF zone.

As soon as the GPS system acquires the position from the satellites, the DSC device makes a second call to the own ship, informing of the exact position of the shipwrecked person.

Then, once the own ship receives the first or second emergency call from the DSC device, it is possible to act in two ways: If said own ship receives the emergency call and is in conditions to respond to it (it has not sunk or there is more crew onboard), it can go ahead with the rescue directly allowing the periodical DSC calls, or it may, if it considers that the rescue does not present any problems, respond to said signal by means of the DSC emitter of the ship with an ACK confirmation signal that cancels the emissions of the DSC device of the shipwrecked person. It must be highlighted that the emission from the AIS device of the shipwrecked person remains active, so that the position of the shipwrecked person continues visible through the AIS receptor of the vessel.

It should be indicated in the point that a vessel that has a class "A" DSC device can emit, whilst if the DSC device of the ship is of class "D" it shall only be capable of receiving data and information but it cannot emit an ACK confirmation signal.

If the own ship does not respond within a specific time period, the time established according to safety criteria, preferably 5 to 10 minutes, the system's intelligent control unit begins to select by order of proximity the MMSI of the closest ships previously identified by the AIS device, to later, through the DSC device, successively call each one of said ships, always ship-to-ship and through channel 70, as we have mentioned above. These calls to the different MMSI located in the area, shall continue constantly until receiving the ACK confirmation signal from one of them, the time when the DSC device of the shipwrecked person stops making DSC calls, both of data and voice, thus acting in a similar way to that described for the case of confirmation by the own ship.

Preferably, the information transmitted by the DSC call, both in data and voice communication, is the following:

MMSI of the shipwrecked person,
report of the MOB situation,
possibility of monitoring of the MOB by AIS device,
possibility of receiving DSC confirmation of reception by an ACK signal acknowledgement of receipt.

Furthermore, it has been provided that the alert system object of invention can be configured so that it works according to military protocols. In said military uses, the microprocessor of the radio beacon can be programmed with a list of "friendly MMSIs", so that from all the MMSIs received through the AIS device of the shipwrecked person, said friendly MMSIs are the only ones that can call. This special military use programming has the option of further cancelling the AIS emission device, so that the position of the shipwrecked person cannot be detected through the AIS device, but it does receive the existing signals. Furthermore, the possibility has been provided that in this programming neither is it emitted by 121.5 MHz until the ACK confirmation signal of a "friendly MMSI" activates it, all in order to avoid interference from third ships undesired in the MOB situation.

On the other hand, if after a certain time has passed since the falling of the man overboard occurred (time established by the maritime rescue organizations), the AIS device of the shipwrecked person has not read MMSI information of any nearby ship, then the DSC device makes a geographic call to all vessels within the VHF range. It should be indicated that said geographic call is not of MAYDAY type (maximum emergency), since this type of call would automatically generate the MAYDAY RELAY (automatic broadcasting of the ship-to-ship call until reaching the coastguards station), but it is of "SECURITE" type (intermediate emergency), which does not activate the MAYDAY RELAY, the recipient ship deciding whether to go ahead with the rescue or inform the coastguards station in order for it to coordinate the rescue. This way of acting is of special use when the closest ships to the shipwrecked person have an AIS device with receiving capacity, but without the capacity to emit its MMSI signal, so that the AIS device of the shipwrecked person does not "see" them, not being able to detect said ships and, in consequence, without the possibility of calling them ship-to-ship.

Finally, after receiving an ACK confirmation signal and the shipwrecked person being rescued, the radio beacon, the DSC device and the AIS device of the alert system object of invention are manually switched off. Nevertheless, if after a time limit, preferably 20 minutes, the shipwrecked person has not been picked up and the radio beacon has manually deactivated, the control unit then reactivates the DSC device, with the entire control process described above restarting.

Preferably, it has been provided that said DSC device additionally comprises means of voice recording and/or playing, whereby it is possible to transmit a distress message, whether through the voice of the shipwrecked person, or by a synthetic voice with the message of "man overboard", MOB.

Finally, it should be indicated that the alert and rescue system described here makes it possible to avoid saturation through communication channel 70, therefore a reduced number of calls are made through said channel. This is due to the fact that the DSC device of the present invention only makes ship-to-ship calls, until it receives a confirmation signal (ACK signal) from one of them. In this way, unlike with the current DSC systems, instead of making continuous calls to all ships until said DSC systems are manually deactivated, the DSC device of the present invention exclusively makes calls to each one of the ships previously detected by the AIS device, until it is recognized by a ship which silences it by an ACK signal, without limitations of previous knowledge of any MMSI, except the military mode of use.

DESCRIPTION OF THE DRAWINGS

To complement the description being made and in order to aid towards a better understanding of the characteristics of the invention, in accordance with a preferred example of practical embodiment thereof, a set of drawings is attached as an integral part of said specification wherein, with illustrative and non-limiting character, the following has been represented.

FIG. 1.—Shows a view of a block diagram where the different elements that make up the alert and rescue system object of the invention can be observed.

PREFERRED EMBODIMENT OF THE INVENTION

An example of preferred embodiment of the alert system (1) object of the invention is described below, without this supposing any limitation in the scope of protection of the present invention.

As can be observed in the block diagram of FIG. 1, the alert and rescue system (1) comprises actuation means (100) connected to a control unit (50) that activates a GPS (Global Positioning System) location device (10) whereby it is possible to obtain the exact location of the shipwrecked person, and a radio beacon (20) adapted to emit a distress signal of 121.5/243 MHz.

Furthermore, the alert and rescue system (1) object of the invention incorporates a DSC (Digital Selective Calling) selective calling device (30), equipped with voice recording and/or playing means (31) which allow transmitting a distress message AIS (Automatic Identification System) automatic identification device (40), both being connected with the control unit (50) and the GPS device (10), and both devices, DSC and AIS (30, 40), having signal emission and reception capacity.

More in particular, the alert system (1) fundamentally stands out due to the combined action of the control unit (50) and said DSC and AIS devices (30, 40), whereby it is possible to perform a repetitive search of vessels close to the shipwrecked person, without stopping in the attempt to communicate until a vessel of those among the closest to the shipwrecked person responds with an ACK confirmation signal. Furthermore, it should also be equally highlighted that all the emergency calls made by the DSC device (30), whether to the own ship or to the vessels located by the AIS device (40), are calls of ship-to-ship type, i.e. only the ship receives the call and no MAYDAY RELAY is generated.

Finally, it should be indicated that the actuation means (100) of the alert system (1) described here can be are manually triggered, by the action of a button (60) designed to be pressed by the shipwrecked person; or can be automatic, through an electronic circuit (70) comprising moisture sensors and/or pressure and/or temperature sensors, among others. More particularly, for the case of the manual actuation means (100), it has been provided that the button (60) incorporates a protection system which avoids the accidental trigger or actuation of the alert system (1), such as a folding cap or cover above the button (60), or incorporates an internal electronic system which demands and requires the button (60) to be kept pressed during a short period of time, such as 3 seconds.

The invention claimed is:

1. An alert and maritime rescue system for a shipwrecked person, designed to be incorporated in the life jacket or suit of the crew member of a vessel, and which comprises actuation means connected to a control unit that activates a GPS (Global Positioning System) location device in order to obtain an exact location of the shipwrecked person that wears said life jacket or suit, and a radio beacon adapted to emit a distress signal by radiofrequency, the system comprising:

a DSC selective calling device, and an AIS automatic identification device, wherein both devices, DSC and AIS, being connected to the GPS device and to the control unit, in order to adapt, through the control unit, the DSC to make emergency calls exclusively to vessels, in the event of a man overboard (MOB) situation, not generating MAYDAY RELAY calls, and allowing the AIS reading and recording of MMSI data of nearby vessels, as well as the monitoring of the MOB situation and DSC and AIS devices having data and voice emission and reception capacity.

2. The alert and maritime rescue system of claim 1, wherein the DSC selective calling device further comprises voice recording and/or playing means, whereby it is possible to transmit a distress message.

3. The alert and maritime rescue system of claim 1, wherein the actuation means are manually triggered.

4. The alert and maritime rescue system of claim 3, wherein the manual actuation means comprise a button designed to be pressed by the shipwrecked person.

5. The alert and maritime rescue system of claim 1, wherein the actuation means are automatic.

6. The alert and maritime rescue system of claim 5, wherein the automatic actuation means comprise an electronic circuit equipped with moisture and/or temperature and/or pressure sensors.

7. A control process of an alert and rescue system for a shipwrecked person, said system designed to be incorporated in the life jacket or suit of the crew member of a vessel and comprising:

actuation means connected to a control unit that activates a GPS (Global Positioning System) location device in order to obtain an exact location of the shipwrecked person that wears said life jacket or suit, and a radio beacon adapted to emit a distress signal by radiofrequency a DSC selective calling device adapted to make emergency calls exclusively to vessels, in the event of a man overboard (MOB) situation, not generating MAYDAY RELAY calls, and an AIS automatic identification device which allows reading and recording of MMSI data of nearby vessels, as well as the monitoring of the MOB situation, both devices, DSC and AIS, being connected to the control unit and to the GPS device, and both having data and voice emission and reception capacity the control process comprising the following stages:

a) immediate activation of an alert system through the actuation means connected to the control unit, after a MOB situation of man overboard occurring, b) constant emission of an alarm signal in the 121.5/243 MHz frequency, by the radio beacon, alerting of the MOB situation to aircraft and vessels located within the range of said signal, c) execution of a first emergency call to the vessel where the shipwrecked person comes from, by the (Digital Selective Calling) DSC selective calling device, alerting of the MOB situation, d) emission of the position of the shipwrecked person and recording of MMSI data of vessels situated within the VHF zone, by the AIS automatic identification device, e) execution of a second emergency call to the vessel where the shipwrecked person comes from, using the DSC device, after the exact position of the shipwrecked person has been acquired through satellites by the GPS location device, and f) reception of an ACK confirmation signal, said confirmation signal being sent by the vessel where the shipwrecked person comes from, or by a vessel close to the shipwrecked person detected by the AIS automatic identification device, which have received some of the calls made by the DSC device; final rescue of the shipwrecked person; and manual switching off of the radio beacon, the DSC device and the AIS automatic identification device.

8. The control process of claim 7, wherein the calls made by the DSC device are exclusively vessel-to-vessel calls.

9. The control process of claim 7, wherein the calls made by the DSC device inform of the following data:

MMSI of the shipwrecked person, report of the MOB situation, possibility of monitoring by AIS device, possibility of receiving confirmation by an ACK confirmation signal.

10. The control process of claim 7, wherein once where the vessel where the shipwrecked person comes from receives the first or second emergency call of the DSC device, it is possible to act in two ways:

i) allow periodical calls of the DSC device of the shipwrecked person, in the event that the vessel where shipwrecked person comes from performs the direct rescue, or ii) cancel the emissions from the DSC device of the shipwrecked person, in the event that the vessel where shipwrecked person comes from responds to the emergency call by means of the DSC emitter of the ship with an ACK confirmation signal.

11. The control process of claim 7, wherein the vessel where shipwrecked person comes from does not respond to the DSC calls made by the shipwrecked person within a specific time period, the control process characterised by the control unit of the system beginning to select by order of proximity the MMSI of the closest vessels previously identified by the MS device, to later, through the DSC device, successively call each one of said vessel, vessel-to-vessel and through a communication channel.

12. The control process of claim 11, wherein the specific time period comprises a range between 5 to 10 minutes.

13. The control process of claim 7, wherein a certain time has passed since the falling of the man overboard occurred and the MS automatic identification device of the shipwrecked person has not read MMSI information of any nearby ship, the control process characterised by the DSC device of the shipwrecked person making a geographic call to all vessels within VHF range.

14. The control process of claim 13, wherein the geographic call is a "SECURITE" call, which does not activate the MAYDAY RELAY.

15. The control process of claim 7, wherein the shipwrecked person has received an ACK confirmation signal, in consequence bringing about the automatic switching off of the alert system and the shipwrecked person has still not been rescued after a time limit, then the control unit, the control process further comprising re-activating the DSC device of the shipwrecked person, with the entire control process restarting.

16. The control process of claim 15, wherein the time limit is 20 minutes.

* * * * *